US008122915B2

(12) United States Patent
Bloch

(10) Patent No.: US 8,122,915 B2
(45) Date of Patent: Feb. 28, 2012

(54) FABRIC, IN PARTICULAR FOR SHADING PURPOSES

(76) Inventor: Klaus Bloch, Sankt Augustin (DE)

( * ) Notice: Subject to any disclaimer, the term of this patent is extended or adjusted under 35 U.S.C. 154(b) by 144 days.

(21) Appl. No.: 12/452,320

(22) PCT Filed: Jan. 25, 2008

(86) PCT No.: PCT/EP2008/000577

§ 371 (c)(1),
(2), (4) Date: Dec. 24, 2009

(87) PCT Pub. No.: WO2009/000340

PCT Pub. Date: Dec. 31, 2008

(65) Prior Publication Data

US 2010/0136311 A1 Jun. 3, 2010

(30) Foreign Application Priority Data

Jun. 26, 2007 (DE) ..... 10 2007 029 565

(51) Int. Cl.

| | |
|---|---|
| ***E06B 9/382*** | (2006.01) |
| ***D03D 1/08*** | (2006.01) |
| ***D03D 3/02*** | (2006.01) |
| *D03D 3/00* | (2006.01) |
| *D03D 11/00* | (2006.01) |

(52) U.S. Cl. ..... 139/384 A; 139/408; 139/426 R; 139/426 TW; 139/420 A

(58) Field of Classification Search ..... 139/383 R, 139/384 R, 387 R, 388–390, 387 A, 384 A, 139/391–394, 403, 405, 408–418, 420 R, 139/426 R, 426 TW, 420 A
See application file for complete search history.

(56) References Cited

U.S. PATENT DOCUMENTS

| | | | | | |
|---|---|---|---|---|---|
| 1,823,034 | A | * | 9/1931 | Dworsky et al. | 442/182 |
| 2,141,038 | A | * | 12/1938 | French | 139/384 A |
| 2,253,374 | A | * | 8/1941 | Haskell | 139/416 |
| 2,269,321 | A | * | 1/1942 | Scheuer | 442/203 |
| 2,287,519 | A | * | 6/1942 | French | 139/384 A |
| 2,339,113 | A | * | 1/1944 | Sarran et al. | 428/54 |
| 2,348,170 | A | * | 5/1944 | Gibbons | 139/384 A |
| 2,409,089 | A | * | 10/1946 | Whitman | 139/420 R |
| 2,585,212 | A | * | 2/1952 | Backer | 139/420 R |
| 2,613,694 | A | * | 10/1952 | French et al. | 139/384 A |
| 2,681,667 | A | * | 6/1954 | Slaughter | 139/387 R |
| 2,703,113 | A | * | 3/1955 | French et al. | 139/384 A |
| 2,874,729 | A | * | 2/1959 | Ball | 139/383 R |
| 2,974,395 | A | * | 3/1961 | Haskel | 428/196 |
| 3,335,762 | A | * | 8/1967 | Noyel | 139/384 R |
| 3,986,824 | A | * | 10/1976 | Waibel et al. | 8/485 |
| 6,537,931 | B1 | * | 3/2003 | Pflug et al. | 442/59 |
| 2011/0132555 | A1 | * | 6/2011 | Rowley et al. | 160/340 |

FOREIGN PATENT DOCUMENTS

| | | |
|---|---|---|
| DE | 20 2006 008 868 U1 | 8/2006 |
| EP | 0 563 757 A1 | 10/1993 |
| GB | 24928 | 0/1903 |

* cited by examiner

*Primary Examiner* — Bobby Muromoto, Jr.
(74) *Attorney, Agent, or Firm* — Pauley Petersen & Erickson

(57) ABSTRACT

A fabric, in particular for shading purposes, formed of interwoven warp and weft threads based on fluoropolymer plastics, wherein the fabric includes an upper side and an underside having colors that are different from one another. The fabric is interwoven from the warp and weft threads in a three by three twill weave with step two, wherein the warp threads and (n+2) consecutive weft threads are made in the color of the upper side of the fabric and n following consecutive weft threads are made in the color of the underside of the fabric and n is an integer greater than or equal to 1.

28 Claims, 1 Drawing Sheet

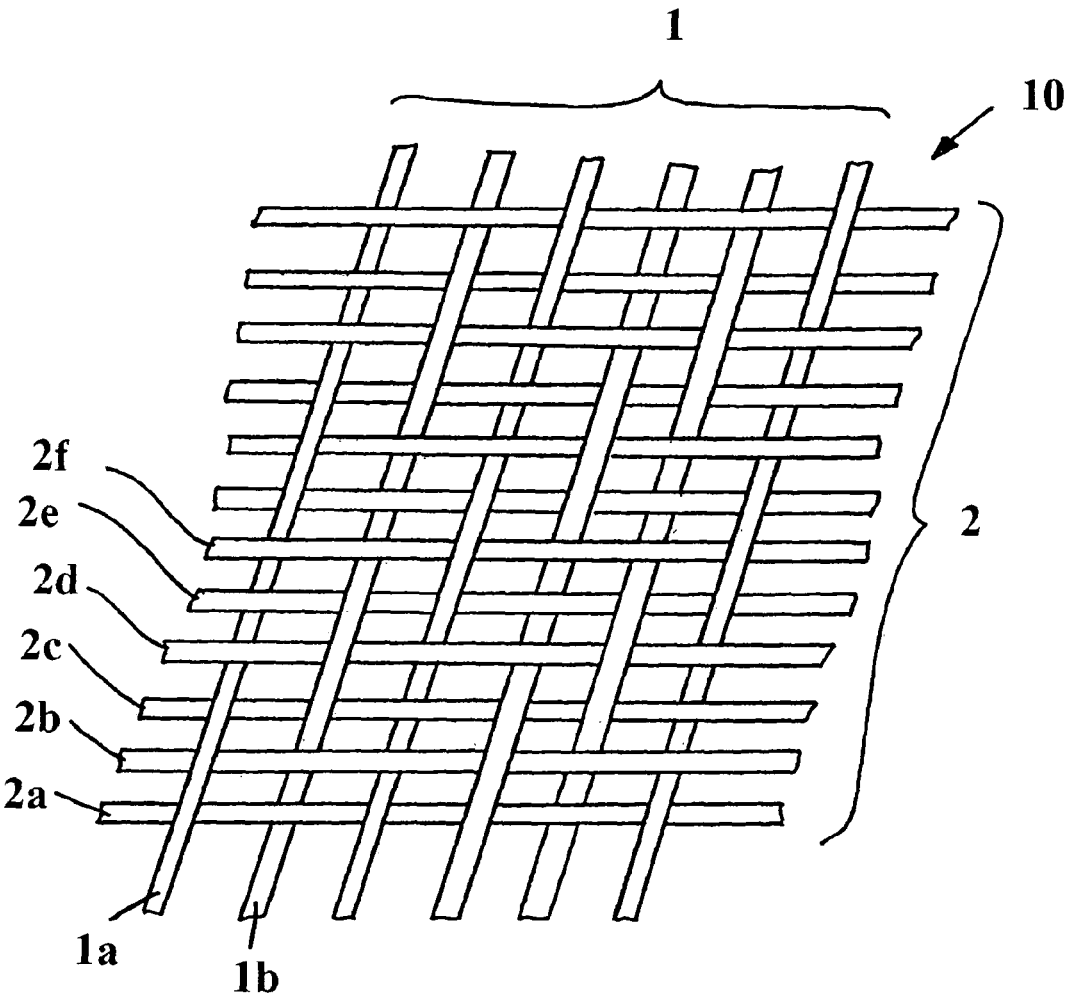
1
10
2
2f
2e
2d
2c
2b
2a
1a
1b

FABRIC, IN PARTICULAR FOR SHADING PURPOSES

BACKGROUND OF THE INVENTION

1. Field of the Invention

This invention relates to a fabric, in particular for shading purposes, formed of interwoven warp and weft threads based on fluoropolymer plastics, wherein the fabric includes an upper side and an underside having colorings that are different from one another.

2. Discussion of Related Art

It is known to use fabrics made from fluoropolymer plastics, in particular polytetrafluoroethylene (PTFE) for textile constructions, for example, long-span structures. The weights per unit area can be between 300 and 2,200 g/m$^2$, with all conceivable weaves of plain weaves, twill weaves, Panama weaves and special weaves applied. Here, PTFE yarns of 380, 440, 880 and 1,200 dtex are used as single yarns or in twist structures with many different yarn and twist structures. The known PTFE yarns used are, in part, naturally white, or also colored, such as sand-colored, green, blue, red, or yellow.

In 1992 or 1993, for example, twelve large-scale screens in white, each with a size of approx. 600 m$^2$, were installed in the Medina mosque as an outdoor long-span structure using such PTFE weaves.

Pure PTFE is mainly used in fabrics for shading purposes that are exposed to such a high degree of insolation, because, according to current knowledge, only PTFE plastics are subject to almost no degradation of strength in regions of such a high exposure to heat and, in particular, ultraviolet irradiation, and because a life span of 25 years and more can be assumed for such fabrics.

Additionally, with regard to prior art, reference may also be made to German Patent Reference DE 20 2006 008 868 U1.

However, one problem of the known PTFE fabrics is that they exhibit only an inadequate shading effect, in particular if colored white. By increasing the weight per unit area from between 600 to 700 g/m$^2$ to at least 900 g/m$^2$, an improvement could be made but which is not sufficient. Also, the problem of insufficient shading effect is also not solved in a satisfactory manner by augmenting the material with colored PTFE yarns, such as, for example, brown or preferably sand-colored yarns, or producing the material exclusively from them, because although the shading effect is increased, the reflecting properties of a pure white fabric vis-à-vis sunbeams, which is at least as important, is lost at the same time, so that only an insufficient reflection of sunbeams takes place, which makes the temperatures under the shading fabric rise in an undesired manner. In colored blended fabrics, the important characteristic values, namely transmission and absorption, as well as heat transfer of the fabric under insolation, are also unfavorable due to reflection being reduced as compared with a pure white fabric, and an increased temperature is caused under the fabric, which must be avoided under all circumstances.

Also, it is known to form a fabric with different colors on its upper and underside, for example, by printing on one side of the fabric or providing it with a coating that has another coloring different from the fabric itself. However, such a coating is difficult to produce and, with regard to its long-term stability, particularly susceptible to UV irradiation, and it also impairs the flexibility of the fabric, which has a very adverse effect, for example if such fabrics are used in umbrellas, on the foldability of the fabric in case it is not used. This also leads to significantly increased weights per unit area, which in turn cause increased mechanical strain on the fabric and its supporting structure.

SUMMARY OF THE INVENTION

It is one object of this invention to provide a fabric of the kind described above but which overcomes the problems of the prior art.

According to this invention, a fabric having the features claimed and described by this specification is proposed for solving the above object. This invention proposes to interweave the fabric from the warp and weft threads in a three by three twill weave with step two, and to make the warp threads and (n+2) consecutive weft threads in the color of the upper side of the fabric and to make n following consecutive weft threads in the color of the underside of the fabric, where n is an integer greater than or equal to 1.

Advantageous embodiments and developments of this invention are further taught by the dependent claims.

BRIEF DESCRIPTION OF THE DRAWINGS

FIG. 1 shows a schematic perspective view of a fabric according to this invention, seen from the upper side.

DETAILED DESCRIPTION OF THE INVENTION

FIG. 1 shows a fabric 10 according to this invention, made of a series of warp threads 1*a*, 1*b* and so on, generally denoted by element reference numeral 1, and a series of weft threads 2*a*, 2*b*, 2*c*, 2*d*, 2*e*, 2*f* and so on, generally denoted by element reference numeral 2, and being interwoven with each other in a manner described below.

This invention proposes to interweave the fabric 10 from the warp and weft threads 1, 2 in a three by three twill weave with step two, and to make the warp threads 1 and (n+2) consecutive weft threads 2 in the color of the upper side of the fabric 10, as shown in FIG. 1, and to make n following consecutive weft threads 2 in the color of the underside of the fabric 10, where n is an integer greater than or equal to 1.

A three by three twill weave with step two is a known weaving method for a person skilled in the art. In such three by three twill weave each warp thread 1 runs over three welt threads 2, followed by running under the next three weft threads 2 and so on.

As shown in FIG. 1, particular warp thread 1*a* first runs over three consecutive weft threads 2*a*, 2*b* and 2*c* on the upper side of the fabric 10 and then runs under the next three consecutive weft threads 2*d*, 2*e*, 2*f* and so on.

Step 2 means that each consecutive warp thread will change from running over or under the weft threads, respectively, in a position two weft threads later than the preceding warp thread.

As shown in FIG. 1, warp thread 1*a* changes from running over the weft threads to running under the weft threads between weft threads 2*c* and 2*d*. However, the next warp thread 1*b* of the fabric 10 changes two weft threads later, namely between weft threads 2*e* and 2*f* from running over the weft threads to running under the weft threads.

Surprisingly, a high-strength fabric 10 that is suitable for shading purposes is formed by this selection of a weaving method according to this invention and by the coordinated coloring of the warp and weft threads, the upper side of the fabric being homogeneous in the one color, and its underside being homogeneous in the other color.

If the warp threads 1 and (n+2) consecutive weft 2 threads, respectively, are made in white, and then, n weft threads 2 in brown, preferably sand-colored coloring, the fabric 10 according to this invention is colored purely white on its upper side and purely sand-colored on its underside, without a weaving pattern showing.

This effect can be achieved with various values for n, it being considered appropriate to set n as follows:

$$1 \leqq n \leqq 4.$$

For example, three consecutive weft threads as well as all warp threads can be made in the color of the upper side, such as white, and the following fourth weft thread can be made in the color of the underside, such as brown or sand-colored.

Within the context of this invention, it is thus possible to manufacture a fabric 10, in particular for shading purposes, without additional coating or printing and the disadvantages connected therewith, which has very high reflectivity of sunbeams due to the pure white coloring of the upper side, and at the same time, due to a darker coloring of the underside, also by a sufficient shading effect, which is adjustable at will.

Thus, the fabric 10 according to this invention is suitable, in particular, for the manufacture of shading devices, for example long-span structures, in which a very high reflection of sunbeams and, at the same time, good shading are of importance. However, other color combinations can also be produced without any problems, depending on areas of use and desired effect, because in that case, the warp and weft threads 1, 2 must be selected and used in the appropriate coloring.

With a view to sufficient stability against UV radiation, the warp and weft threads 1, 2 are preferably formed of pure polytetrafluoroethylene, and they are preferably cut in the appropriate yarn size from a flat sheet material.

The warp threads 1 of the fabric according to this invention preferably have a thread count of 90 to 120 threads/cm, and they are made in a yarn size of 380 to 440 dtex.

In order to generate a higher strength, the warp threads 1 are furthermore twisted with 500 to 700 turns per meter (t.p.m.) about their longitudinal axis.

The weft threads 2 preferably have a thread count of 45 to 60 threads/cm, wherein the weft threads 2 made in the color of the upper side also have a yarn size that is less than that of the weft threads 2 made in the color of the underside. For example, it is possible to make the weft threads 2 made in the color of the upper side in a yarn size of between 380 to 420 dtex, so that they correspond to the yarn size of the warp threads 1, and to design the weft threads 2 made in the color of the underside in a larger yarn size of, for example, 440 to 480 dtex.

The weft threads 2 are also preferably twisted about their longitudinal axis, also with about 500 to 700 t.p.m. in a first direction of rotation. It is further preferred that the weft threads 2 are formed of two single threads twisted in this manner, which, having been twisted individually, are twined together with about 300 to 400 t.p.m. in the opposite direction of rotation. In conjunction with also the warp threads 1 being twisted, the fabric 10 according to this invention obtains a strength that is almost the same in the direction of both the warp and the weft, which is very advantageous in particular for applications of the fabric 10 according to this invention in round formats.

It is also preferred that two such weft threads 2 at a time are inserted into a shed in parallel and that together, they form a weft of the fabric 10 according to this invention.

At the same time, the three by three twill weave provided according to this invention provides a high seam strength, and the fabric 10 according to this invention is rain-proof even without additional coating or finish.

Preferred weights per unit are of the fabric 10 produced according to this invention lie in the range from between 900 to 930 g/m$^2$ at a thickness of 0.57 to 0.61 mm.

EXEMPLARY EMBODIMENT

As a fabric for shading purposes, in particular for use as an outdoor bearing structure, white warp threads having a thread count of 98 threads/cm, with a tolerance of ±5%, and a yarn size of 380 dtex and with 700 t.p.m. were twisted, and weft threads having a thread count of 53 threads/cm±5% were used, wherein the respective first and third weft threads with a white color were used, matching the warp threads, in a yarn size of 380 dtex, which were formed of single threads twisted with 700 t.p.m., then, in pairs of threads twined with 300 t.p.m. in the opposite direction. The respective fourth weft thread was sand-colored, had a yarn size of 440 dtex, and was twisted from single threads with 700 t.p.m., and then, twined in pairs of threads with 300 t.p.m. in the opposite direction.

Thus, n was set to be equal to 1.

Using a three by three twill weave with step two, the warp and weft threads became a fabric with a fabric weight of 905 g/m$^2$ and about 0.59 mm thickness.

A pure white upper side of the fabric and a sand-colored underside corresponding to the color of every fourth weft thread used appeared, which had comparable strengths in the directions of warp and weft, and which provided for rain proofness.

The fabric thus formed was subjected to a measurement of the radiometric, photometric and UV characteristic values, such as transmission, reflection, and absorption, in accordance with DIN EN 410, with the results determined for almost normal incidence, 0° for transmission, 8° for reflection, on the white or sand-colored side of the fabric being given in the following table.

| | radiometric values | | | photometric values | | | UV values | | |
|---|---|---|---|---|---|---|---|---|---|
| | $T_{s,nh}$ | $R_{s,nh}$ | $A_{s,nh}$ | $T_{v,nh}$ | $R_{v,nh}$ | $A_{v,nh}$ | $T_{UV,nh}$ | $R_{UV,nh}$ | $A_{UV,nh}$ |
| white side | 0.22 | 0.68 | 0.10 | 0.15 | 0.69 | 0.16 | 0.09 | 0.70 | 0.21 |
| sand-colored side | 0.22 | 0.61 | 0.16 | 0.16 | 0.59 | 0.26 | 0.09 | 0.54 | 0.37 |

Alternatively, n may also be 2, 3 or 4, such as where:

n=2, the first four weft threads are made in the color of the upper side and the next two weft threads in the color of the underside n=3, the first five weft threads are made in the color of the upper side and the next three weft threads in the color of the underside n=4, the first six weft threads are made in the color of the upper side and the next four weft threads in the color of the underside This does not change the intended effect of, for example, a white upper side and an underside that is colored differently thereto, and only the color intensity of the underside increases with a growing n.

The invention claimed is:

1. A fabric (10), for shading, formed of interwoven warp and weft threads (1, 2) based on fluoropolymer plastics, wherein the fabric (10) comprises an upper side and an underside having colors that are different from one another, the fabric (10) inter-woven from the warp and weft threads (1, 2) in a three by three twill weave with step two, wherein the warp threads (1) and (n+2) consecutive weft threads (2) are made in a first color of the upper side of the fabric (10) and n following consecutive weft threads (2) are made in a second color of the underside of the fabric (10), and n is an integer greater than or equal to 1.

2. The fabric according to claim 1, wherein n is an integer less than or equal to 4.

3. The fabric according to claim 2, wherein the warp threads (1) and three consecutive weft threads (2) are made in the first color of the upper side of the fabric (10), and every fourth weft thread (2) is made in the second color of the underside of the fabric (10).

4. The fabric according to claim 3, wherein the warp and weft threads (1, 2) are formed of polytetrafluoroethylene.

5. The fabric according to claim 4, wherein the warp threads (1) have a thread count in a range of 90 to 120 threads/cm.

6. The fabric according to claim 5, wherein the warp threads (1) have a yarn size of 380 to 440 dtex.

7. The fabric according to claim 6, wherein the warp threads (1) are twisted with 500 to 700 t.p.m. about their longitudinal axis.

8. The fabric according to claim 7, wherein the weft threads (2) have a thread count of 45 to 60 threads/cm.

9. The fabric according to claim 8, wherein the weft threads (2) made in the first color of the upper side have a yarn size that is less than that of the weft threads (2) made in the second color of the underside.

10. The fabric according to claim 9, wherein the weft threads (2) made in the first color of the upper side have a yarn size of 380 to 420 dtex, and the weft threads (2) made in the second color of the underside have a yarn size of 440 to 480 dtex.

11. The fabric according to claim 10, wherein the weft threads (2) are formed of single threads twisted with 500 to 700 t.p.m. about their longitudinal axis in a first direction of rotation, of which two at a time are twined together with 300 to 400 t.p.m. in an opposite direction of rotation about their axis of rotation.

12. The fabric according to claim 11, wherein two parallel weft threads (2) at a time are interwoven as a weft.

13. The fabric according to claim 11, wherein the upper side has a white coloring, and the underside has a sand-colored coloring.

14. The fabric according to claim 13, wherein the fabric has a weight per unit area of 900 to 930 g/m$^2$.

15. The fabric according to claim 14, wherein the fabric has a thickness of 0.57 to 0.61 mm.

16. The fabric according to claim 1, wherein the warp threads (1) and three consecutive weft threads (2) are made in the first color of the upper side of the fabric (10), and every fourth weft thread (2) is made in the second color of the underside of the fabric (10).

17. The fabric according to claim 1, wherein the warp and weft threads (1, 2) are formed of polytetrafluoroethylene.

18. The fabric according to claim 1, wherein the warp threads (1) have a thread count in a range of 90 to 120 threads/cm.

19. The fabric according to claim 1, wherein the warp threads (1) have a yarn size of 380 to 440 dtex.

20. The fabric according to claim 1, wherein the warp threads (1) are twisted with 500 to 700 t.p.m. about their longitudinal axis.

21. The fabric according to claim 1, wherein the weft threads (2) have a thread count of 45 to 60 threads/cm.

22. The fabric according to claim 1, wherein the weft threads (2) made in the first color of the upper side have a yarn size that is less than that of the weft threads (2) made in the second color of the underside.

23. The fabric according to claim 22, wherein the weft threads (2) made in the first color of the upper side have a yarn size of 380 to 420 dtex, and the weft threads (2) made in the second color of the underside have a yarn size of 440 to 480 dtex.

24. The fabric according to claim 1, wherein the weft threads (2) are formed of single threads twisted with 500 to 700 t.p.m. about their longitudinal axis in a first direction of rotation, of which two at a time are twined together with 300 to 400 t.p.m. in an opposite direction of rotation about their axis of rotation.

25. The fabric according to claim 1, wherein two parallel weft threads (2) at a time are interwoven as a weft.

26. The fabric according to claim 1, wherein the upper side has a white coloring, and the underside has a sand-colored coloring.

27. The fabric according to claim 1, wherein the fabric has a weight per unit area of 900 to 930 g/m$^2$.

28. The fabric according to claim 1, wherein the fabric has a thickness of 0.57 to 0.61 mm.

* * * * *